US010902799B2

(12) United States Patent
Song et al.

(10) Patent No.: US 10,902,799 B2
(45) Date of Patent: Jan. 26, 2021

(54) DISPLAY APPARATUS AND METHOD FOR DRIVING THE DISPLAY APPARATUS FOR LOCALLY DIMMING TO SUPPRESS MOTION BLUR

(71) Applicant: SAMSUNG ELECTRONICS CO., LTD., Suwon-si (KR)

(72) Inventors: Wonseok Song, Suwon-si (KR); Shinhaeng Kim, Suwon-si (KR); Yoosun Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 18 days.

(21) Appl. No.: 16/259,215

(22) Filed: Jan. 28, 2019

(65) Prior Publication Data

US 2020/0135122 A1 Apr. 30, 2020

(30) Foreign Application Priority Data

Oct. 24, 2018 (KR) ..... 10-2018-0127783

(51) Int. Cl.

*G09G 3/34* (2006.01)
*G09G 3/36* (2006.01)
*G09G 3/3233* (2016.01)

(52) U.S. Cl.

CPC ..... *G09G 3/3426* (2013.01); *G09G 3/3413* (2013.01); *G09G 3/3607* (2013.01); *G09G 3/3677* (2013.01); *G09G 3/3688* (2013.01); *G09G 3/3233* (2013.01); *G09G 2310/08* (2013.01); *G09G 2320/0247* (2013.01); *G09G 2320/0261* (2013.01)

(58) Field of Classification Search

CPC .. G09G 3/3426; G09G 3/3413; G09G 3/3607; G09G 3/3677; G09G 3/3688;

(Continued)

(56) References Cited

U.S. PATENT DOCUMENTS

2005/0168492 A1* 8/2005 Hekstra ..... G09G 3/20 345/690
2011/0206126 A1 8/2011 Kim (Continued)

FOREIGN PATENT DOCUMENTS

JP 2013-171258 A 9/2013
JP 2016-48298 A 4/2016

(Continued)

OTHER PUBLICATIONS

Brett Larimore "LED Lighting and DC-DC Conversion Control Integrated on One C2000 Microcontroller" Texas Instruments, Application Report SPRABR2, Sep. 17, 2013 (28 pages total).

(Continued)

*Primary Examiner* — Yaron Cohen

(74) *Attorney, Agent, or Firm* — Sughrue Mion, PLLC

(57) ABSTRACT

A display apparatus is provided. The display apparatus includes a display panel; a backlight including a plurality of backlight blocks; and a processor configured to: identify a duty cycle of a driving signal for driving each of the plurality of backlight blocks; drive the backlight based on the duty cycle of the driving signal; identify a motion blur occurrence area in an input image; identify an adjusted duty cycle by adjusting the duty cycle of at least one backlight block from among the plurality of backlight blocks that corresponds to the motion blur occurrence area; and adjust a current of the driving signal based on the adjusted duty cycle.

14 Claims, 21 Drawing Sheets

(58) Field of Classification Search
CPC ..... G09G 3/3233; G09G 2310/08; G09G 2320/0247; G09G 2320/0261; G09G 3/2014; G09G 2320/106; G09G 2340/16; G09G 2360/16; G09G 2360/141
See application file for complete search history.

(56) References Cited

U.S. PATENT DOCUMENTS

| | | | | |
|---|---|---|---|---|
| 2012/0013652 | A1* | 1/2012 | Onishi | G09G 3/3426 345/690 |
| 2018/0018918 | A1* | 1/2018 | Miyake | G09G 3/36 |
| 2018/0090078 | A1 | 3/2018 | Chang | |
| 2019/0206337 | A1 | 7/2019 | Jung et al. | |

FOREIGN PATENT DOCUMENTS

| | | | |
|---|---|---|---|
| KR | 10-2010-0004614 | A | 1/2010 |
| KR | 10-0956567 | B1 | 5/2010 |
| KR | 10-2011-0062437 | A | 6/2011 |
| KR | 10-1094304 | B1 | 12/2011 |
| KR | 10-1796718 | B1 | 11/2017 |
| KR | 10-1801306 | B1 | 11/2017 |
| KR | 10-2018-0045608 | A | 5/2018 |
| KR | 10-2019-0082565 | A | 7/2019 |
| WO | 03/100724 | A2 | 12/2003 |
| WO | 2010/135438 | A1 | 11/2010 |
| WO | 2010/141739 | A2 | 12/2010 |

OTHER PUBLICATIONS

Communication dated Jul. 24, 2019, issued by the European Patent Office in counterpart European Patent Application No. 19156288.3.
International Search Report dated Feb. 17, 2020 issued by the International Searching Authority in counterpart International Application No. PCT/KR2019/013901 (PCT/ISA/210).
Written Opinion dated Feb. 17, 2020 issued by the International Searching Authority in counterpart International Application No. PCT/KR2019/013901 (PCT/ISA/237).

* cited by examiner

DISPLAY APPARATUS AND METHOD FOR DRIVING THE DISPLAY APPARATUS FOR LOCALLY DIMMING TO SUPPRESS MOTION BLUR

CROSS-REFERENCE TO RELATED APPLICATION

This application is based on and claims priority under 35 U.S.C. § 119 to Korean Patent Application No. 10-2018-0127783, filed on Oct. 24, 2018, in the Korean Intellectual Property Office, the disclosure of which is incorporated by reference herein in its entirety.

BACKGROUND

1. Field

The disclosure relates to a display apparatus and a method for driving same. More particularly, the disclosure relates to a display apparatus including a backlight, and a method for driving same.

2. Description of Related Art

A liquid crystal display apparatus is a display apparatus which expresses a desired image using a liquid crystal layer having an anisotropic permittivity on a transparent insulation substrate at the top and the bottom. A molecular arrangement of a liquid crystal material is changed by adjusting an intensity of electrical field formed on the liquid crystal layer, thereby adjusting an amount of light permitted to transmit through the transparent insulation substrate.

For a liquid crystal display apparatus, a thin film transistor (TFT) liquid crystal display (LCD) using a thin film transistor as a switching device is commonly used. The liquid crystal display apparatus may include a liquid crystal panel including pixels driven by gate lines and data lines disposed to intersect each other to display an image, a driver to drive the liquid crystal panel, a backlight unit to supply light to a liquid crystal panel, and a color filter to filter light supplied to the liquid crystal panel.

Because the liquid crystal display apparatus maintains an output image signal for a predetermined time to display an image, there is a problem that a motion blur occurs.

The above information is presented as background information only to assist with an understanding of the disclosure. No determination has been made, and no assertion is made, as to whether any of the above might be applicable as prior art with regard to the disclosure.

SUMMARY

In accordance with an aspect of the disclosure, there is provided A display apparatus. The display apparatus includes: a display panel; a backlight including a plurality of backlight blocks; and a processor configured to: identify a duty cycle of a driving signal for driving each of the plurality of backlight blocks; drive the backlight based on the duty cycle of the driving signal; identify a motion blur occurrence area in an input image; identify an adjusted duty cycle by adjusting the duty cycle of at least one backlight block from among the plurality of backlight blocks that corresponds to the motion blur occurrence area; and adjust a current of the driving signal based on the adjusted duty cycle.

In accordance with an aspect of the disclosure, the processor may be further configured to reduce the duty cycle of the at least one backlight block corresponding to the motion blur occurrence area and increase the current of the driving signal.

In accordance with an aspect of the disclosure, the processor may be further configured to identify the motion blur occurrence area based on motion information, image characteristic information and brightness information of the input image.

In accordance with an aspect of the disclosure, the image characteristic information may include at least one among edge information and texture information.

In accordance with an aspect of the disclosure, the processor may be further configured to identify the brightness information based on pixel information of the input image and a light emission characteristic of the display panel.

In accordance with an aspect of the disclosure, the processor may be further configured to: identify a plurality of block areas of the input image; and identify the motion blur occurrence area based on motion information, image characteristic information and brightness information of each of the plurality of block areas.

In accordance with an aspect of the disclosure, the processor may be further configured to: obtain motion information, image characteristic information and brightness information from a first block area of a plurality of block areas of the input image; obtain motion blur information based on the motion information, the image characteristic information and the brightness information; and identify the motion blur occurrence area based on the motion blur information.

In accordance with an aspect of the disclosure, the processor may be further configured to obtain the motion blur information by calculating a motion blur value based on each of the motion information, the image characteristic information and the brightness information, apply a weight to the motion blur value, and multiply the motion blur values to which the weight is applied by one another.

In accordance with an aspect of the disclosure, the processor may be further configured to drive the backlight by sequentially reducing the duty cycle for each frame interval of the motion blur occurrence area and sequentially increasing the current of the driving signal.

In accordance with an aspect of the disclosure, the display panel may be a liquid crystal panel.

In accordance with an aspect of the disclosure, there is provided a method for driving a display apparatus including a display panel and a backlight which includes a plurality of backlight blocks. The method includes: identifying a duty cycle of a driving signal for driving each of the plurality of backlight blocks; identifying a motion blur occurrence area in an input image; identifying an adjusted duty cycle by adjusting the duty cycle of at least one backlight block from among the plurality of backlight blocks that corresponds to the motion blur occurrence area; identifying an adjusted current of the driving signal based on the adjusted duty cycle; and driving the backlight based on the adjusted duty cycle and the adjusted current.

In accordance with an aspect of the disclosure, the driving the backlight may include: reducing the duty cycle of the at least one backlight block corresponding to the motion blur occurrence area; and increasing a current of the driving signal to identify the adjusted current.

In accordance with an aspect of the disclosure, the identifying the motion blur occurrence area may include identifying the motion blur occurrence area based on motion information, image characteristic information and brightness information of the input image.

In accordance with an aspect of the disclosure, the image characteristic information may include at least one of edge information and text information.

In accordance with an aspect of the disclosure, the identifying the motion blur occurrence area may include identifying the brightness information based on pixel information of the input image and a light emission characteristic of the display panel.

In accordance with an aspect of the disclosure, the identifying the motion blur occurrence area may include: identifying a plurality of block areas of the input image; and identifying the motion blur occurrence area based on motion information, image characteristic information and brightness information of each of the plurality of block areas.

In accordance with an aspect of the disclosure, the identifying the motion blur occurrence area may include: obtaining motion information, image characteristic information and brightness information from a first block area of a plurality of block areas of the input image; obtaining motion blur information based on the motion information, the image characteristic information and the brightness information; and identifying the motion blur occurrence area based on the motion blur information.

In accordance with an aspect of the disclosure, the identifying the motion blur occurrence area may include obtaining the motion blur information by calculating a motion blur value based on each of the motion information, the image characteristic information and the brightness information; applying a weight to each of motion blur values; and multiplying the motion blur values to which the weight is applied by one another.

In accordance with an aspect of the disclosure, the driving the backlight may include sequentially reducing the duty cycle for each frame interval of the motion blur occurrence area and sequentially increasing the adjusted current of the driving signal.

In accordance with an aspect of the disclosure, there is provided a non-transitory computer-readable medium configured to store one or more computer programs containing commands that, when executed by a processor of a display apparatus including a backlight, cause the display apparatus to perform an operation, the operation including: identifying a duty cycle of a driving signal for driving each of a plurality of backlight blocks; identifying a motion blur occurrence area in an input image; and identifying an adjusted duty cycle by adjusting the duty cycle of at least one backlight block from among the plurality of backlight blocks that corresponds to the motion blur occurrence area; identifying an adjusted current of the driving signal based on the adjusted duty cycle; and driving the backlight based on the adjusted duty cycle and the adjusted current.

In accordance with an aspect of the disclosure, an apparatus is provided. The apparatus includes: an interface configured to receive an image signal; a backlight driver configured to drive a plurality of backlight blocks of a backlight; and a processor configured to: identify a first block from among the plurality of backlight blocks corresponding to a motion blur occurrence area in the image signal; and control the backlight driver to drive the first block at a first voltage level and a first duty cycle, and drive a second block from among the plurality of backlight blocks at a second voltage level and a second duty cycle.

In accordance with an aspect of the disclosure, the first voltage level may be greater than the second voltage level.

In accordance with an aspect of the disclosure, the first duty cycle may be less than the second duty cycle.

In accordance with an aspect of the disclosure, the processor may be further configured to identify the motion blur occurrence area based on a plurality of frames of the image signal.

BRIEF DESCRIPTION OF THE DRAWINGS

The above and other aspects, features, and advantages of certain embodiments of the present disclosure will be more apparent from the following description taken in conjunction with the accompanying drawings, in which.

The same reference numerals are used to represent the same, or similar, elements throughout the drawings.

DETAILED DESCRIPTION

One or more embodiments will be described below in greater detail with reference to the accompanying drawings.

Hereinafter, the terms used in embodiments will be briefly explained, and embodiments will be described in greater detail with reference to the accompanying drawings.

The terms used in the present disclosure are general terms which are widely used now and selected considering the functions of the present disclosure. However, the terms may vary depending on the intention of a person skilled in the art, a precedent, or the advent of new technology. In addition, in a specified case, the term may be arbitrarily selected. In this case, the meaning of the term will be explained in the corresponding description. Accordingly, the terms used in the description should not necessarily be construed as simple names of the terms, but be defined based on meanings of the terms and overall contents of the present disclosure.

In the description, the term "has", "may have", "includes" or "may include" indicates existence of a corresponding feature (e.g., a numerical value, a function, an operation, or a constituent element such as a component), but does not exclude existence of an additional feature.

The expression "at least one of A and B" should be construed as referring to any one of "A", "B" and "A and B".

As used herein, the terms "1st" or "first" and "2nd", or "second" may use corresponding components regardless of importance or order and are used to distinguish a component from another without limiting the components.

If it is described that a certain element (e.g., first element) is "operatively or communicatively coupled with/to" or is "connected to" another element (e.g., second element), it should be understood that the certain element may be connected to the other element directly or through still another element (e.g., third element).

It is to be understood that the singular forms "a," "an," and "the" include plural referents unless the context clearly dictates otherwise. The terms "include", "comprise", "is configured to," etc., of the description are used to indicate that there are features, numbers, steps, operations, elements, parts or combination thereof, and they should not exclude the possibilities of combination or addition of one or more features, numbers, steps, operations, elements, parts or a combination thereof.

In the present disclosure, a "module" or a "unit" performs at least one function or operation, and may be implemented by hardware or software or a combination of the hardware and the software. In addition, a plurality of "modules" or a plurality of "units" may be integrated into at least one module and may be realized as at least one processor except for "modules" or "units" that should be realized in a specific hardware.

Hereinafter, embodiments will be described in greater detail with reference to the accompanying drawings.

Figure 1:
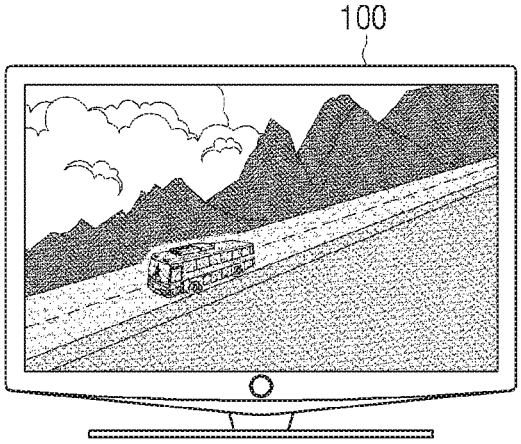
FIG. 1 is a diagram illustrating a characteristic of a display panel, according to an embodiment.

FIG. 1 is a diagram illustrating a display panel, according to an embodiment.

A backlight may be provided for a display panel implemented as a non-self-illuminating device, e.g., a liquid crystal display (LCD) panel, to realize an image.

The LCD panel realizing an image by a backlight may maintain an output image signal for a predetermined time to display the image. However, oculogyration is a continuous motion, whereas an image that is visible is in a stationary state in an interval where an output signal is maintained, and thus a motion blur thereby occurs. Herein, the motion blur refers to an image dragging phenomenon in which boundaries of a moving object are not distinguished from each other but look overlapped. The motion blur phenomenon may occur with an object area with a large movement as illustrated in FIG. 1, but may be more easily recognized from an object area with clear boundaries, etc.

Backlight dimming may be used to reduce the motion blur that occurs on the LCD panel. For example, local dimming may be used to divide a screen into multiple areas and individually control a backlight lighting time for each area. As another example, global dimming may be used to collectively control a backlight lighting time of the entire screen. If a length of an interval in which an image signal is visible is reduced using the backlight dimming, the motion blur may be reduced as much.

However, when the entire backlight lighting time is reduced according to the global dimming, the overall screen brightness may be reduced. In addition, when the backlight lighting time is excessively reduced, a flickering phenomenon due to a backlight blinking may occur in a flat stop area. Accordingly, various embodiments to reduce the motion blur by local dimming will be described below.

Figure 2:
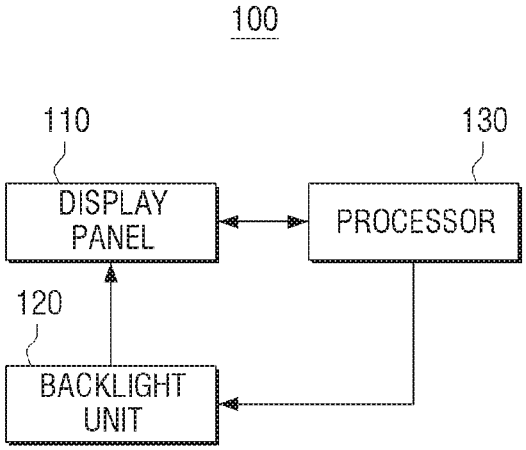
FIG. 2 is a block diagram illustrating a configuration of a display apparatus, according to an embodiment.

FIG. 2 is a block diagram illustrating a configuration of a display apparatus, according to an embodiment.

Referring to FIG. 2, the display apparatus 100 includes a display panel 110, a backlight unit 120, and a processor 130.

The display apparatus 100 may be implemented as a smartphone, a tablet PC, a smart TV, an Internet TV, a web TV, an Internet protocol television (IPTV), signage, a PC, a monitor, and etc. However, the present disclosure is not limited thereto, and the display apparatus 100 may be implemented as various types of apparatuses with a display function, such as a large format display (LFD), a digital signage, a digital information display (DID), a video wall, a projector display, and the like.

The display panel 110 may include a plurality of pixels, and the respective pixels may include a plurality of sub-pixels. For example, the respective pixels may include three sub-pixels corresponding to a plurality of lights such as red, green and blue lights. However, the present disclosure is not limited thereto, and in addition to sub-pixels of red, green and blue colors, sub-pixels of cyan, magenta, yellow, black or other sub-pixels may be included. Here, the display panel 110 may be implemented as a liquid crystal panel. However, if a backlight dimming according to an embodiment is applicable, the display panel 110 may be implemented as a display panel of another type as well.

The backlight unit 120 may irradiate the light to the display panel 110.

For example, the backlight unit 120 may irradiate the light onto the display panel 110 from a rear surface of the display panel 110, that is, an opposite surface of a surface on which an image is displayed.

The backlight unit 120 may include a number of light sources, and the light sources may include a linear light source such as a lamp, a point light source such as a light emitting diode, and the like, but are not limited thereto. The backlight unit 120 may be implemented as a backlight unit of a direct type or a backlight unit of an edge type. The light sources of the backlight unit 120 may include any one type or at least two types from among light emitting diode (LED), hot cathode fluorescent lamp (HCFL), cold cathode fluorescent lamp (CCFL), external electrode fluorescent lamp (EEFL), ELP, and flat fluorescent lamp (FFL).

According to an embodiment, the backlight unit 120 may be implemented as a plurality of LED modules and/or as a plurality of LED cabinets. The LED module may include a plurality of LED pixels. According to an embodiment, the LED pixels may be implemented as a blue LED or a white LED, but are not limited thereto, and may be also implemented as including at least one from among the red LED, the green LED, and the blue LED.

The processor 130 may include various processing circuitry and controls overall operations of the display apparatus 100.

According to an embodiment, the processor 130 may be implemented as a digital signal processor (DSP), a microprocessor, and a time controller (TCON). However, the present disclosure is not limited thereto. The processor 130 may include one or more from among various processing circuitry, such as, for example, and without limitation, one or more of a dedicated processor, a central processing unit (CPU), a micro controller unit (MCU), a micro processing unit (MPU), a controller, an application processor (AP), a graphics-processing unit (GPU) or a communication processor (CP), and an ARM processor. In addition, the processor 130 may be implemented as a system on chip (SoC) in which a processing algorithm is mounted and a large scale integration (LSI), and may also be implemented in the form of a field programmable gate array (FPGA). The processor 130 may execute computer executable instructions stored in the storage 170 so that various functions may be thereby performed.

The processor 130 may drive the backlight unit 120 to provide a light to the display panel 110. For example, the processor 130 may adjust at least one of a supply time and intensity of a driving current (or driving voltage) supplied to the backlight unit 120.

For example, the processor 130 may control a brightness of light sources included in the backlight unit by means of pulse width modulation (PWM) in which a duty ratio is variable, and control the brightness of the light sources of the backlight unit 120 by varying the current intensity. Here, the PWM controls the ratio of lighting and lights-out of the light sources, and the duty ratio (%) thereof is determined according to the dimming value input from the processor 130.

In this case, the processor 130 may be implemented to include a driver integrated circuit (IC) for driving the backlight unit 120. For example, the processor 130 may be implemented as a digital signal processor (DSP), and may be implemented as a digital driver IC and one chip. However, the driver IC may be implemented as a hardware separate from the processor 130. For example, in a case that light sources included in the backlight unit 120 are implemented as an LED device, the driver IC may be implemented as at least one LED driver controlling a current applied to the LED device. According to an embodiment, the LED driver may be disposed at the rear end of the power supply (e.g., switching mode power supply (SMPS)), and receive a voltage from the power supply. However, according to another embodiment, the LED driver may receive a voltage from a separate power supply device. According to yet another embodiment, the SMPS and the LED driver are realized as one integrated module.

The processor 130 may obtain a dimming ratio for driving the backlight unit 120, that is, a lighting duty of current (hereinafter referred to as "current duty"). For example, the processor 130 may obtain a current duty for driving the backlight unit 120 based on pixel information (or physical quantity of pixel) of an input image. Here, the pixel information may be at least one of an average pixel value, maximum pixel value (or peak pixel value), minimum pixel value and average picture level (APL) of the input image. In addition, the pixel information may be at least one of an average pixel value, maximum pixel value (or peak pixel value), minimum pixel value and medium pixel value of the respective image block areas included in the input image. In this case, the pixel value may include at least one of a brightness value (or gradation value) and a color coordinate value. Hereinafter, it will be assumed that an APL is used as pixel information, for convenience of explanation.

The processor 130 may obtain pixel information for each predetermined intervals of the input image, e.g., a dimming ratio for driving the backlight unit 120 for each interval based on the APL information, i.e., a current duty. Here, the predetermined interval may be one frame interval. However, the present disclosure is not limited thereto, and the predetermined interval may be a plurality of frame intervals, a scene interval, and the like. In this case, the processor 130 may obtain a current duty based on pixel information on the basis of a predetermined function (or operation algorithm), but current duty information according to the pixel information may be pre-stored as, for example, a lookup table or a graph.

For example, the processor 130 may convert a by-frame pixel data (RGB) to a brightness level according to a predetermined conversion function, and calculate an APL for each frame by dividing a sum of brightness levels into the number of entire pixels. However, the present disclosure is not limited thereto, and other APL calculation methods may be used as well. Subsequently, the processor 130 may control a current duty to be 100% in an image frame of which the APL is a predetermined value (e.g., 80%), and identify a current duty corresponding to the respective APL values by means of a function to reduce a current duty of an image frame of an APL value less than or equal to 80% to be in inverse proportion to the APL value linearly or non-linearly. However, in a case that a current duty corresponding to the APL value is stored in a lookup table, a current duty may be read from the lookup table with the APL as a read address.

Meanwhile, the processor 130 may drive the backlight unit 120 through local dimming by dividing a screen into a plurality of areas and individually controlling a backlight brightness for each area.

For example, the processor 130 may divide the screen into a plurality of screen areas capable of being individually controlled according to an implementation form of the backlight unit 120, and obtain pixel information of an image (hereinafter referred to as "image area") to be displayed on the respective screen areas, e.g., a current duty for respectively driving a light source of the backlight unit 120 corresponding to the respective image areas on the basis of the APL information. Hereinafter, each of the backlight areas respectively corresponding to a plurality of image areas will be referred to as a backlight block, for convenience of explanation. For example, the respective backlight block may include at least one light source, e.g., a plurality of light sources.

Figure 3A:
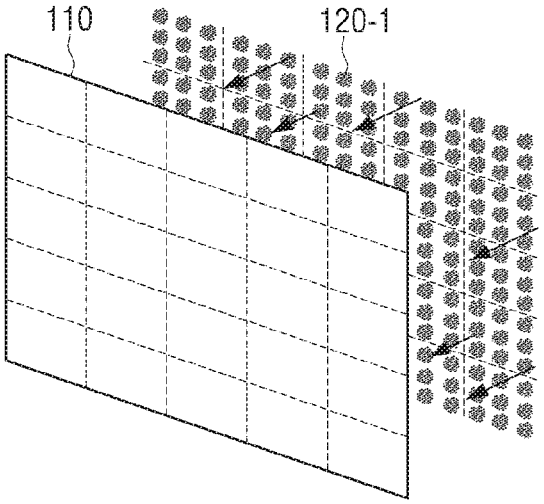
FIGS. 3A and 3B are diagrams illustrating local dimming methods, according to various embodiments.

According to an embodiment, the backlight unit 120 may be implemented as a direct-type backlight unit 120-1 as illustrated in FIG. 3A. For example, the direct-type backlight unit 120-1 may be implemented as a structure in which a number of optical sheets and a diffusion plate are layered at a bottom part of the display panel 110 and a number of light sources are arranged at a bottom part of the diffusion plate.

The direct-type backlight unit 120-1 may be divided into a plurality of backlight blocks as illustrated in FIG. 3A, on the basis of a disposition structure of the plurality of light sources. In this case, the plurality of backlight blocks may be, as illustrated, respectively driven according to a current duty based on image information of a corresponding screen area.

Figure 3B:
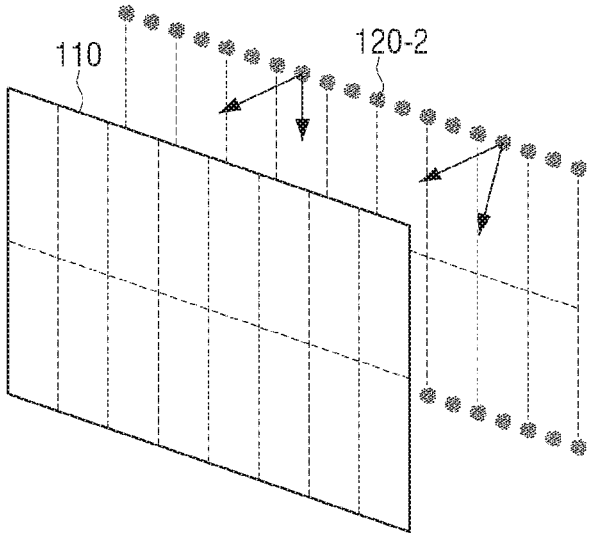

According to another embodiment, the backlight unit 120 may be implemented as an edge-type backlight unit 120-2 as illustrated in FIG. 3B. For example, the edge-type backlight unit 120-2 may be implemented as a structure in which a number of optical sheets and a light guide panel are layered at a bottom part of the display panel 110 and a number of light sources are arranged on a side surface of the light guide panel.

The edge-type backlight unit 120-2 may be divided into a plurality of backlight blocks as illustrated in FIG. 3B, on the basis of a disposition structure of the plurality of light sources. In this case, the plurality of backlight blocks may be, as illustrated, respectively driven according to a current duty based on image information of a corresponding screen area.

Figure 4A:
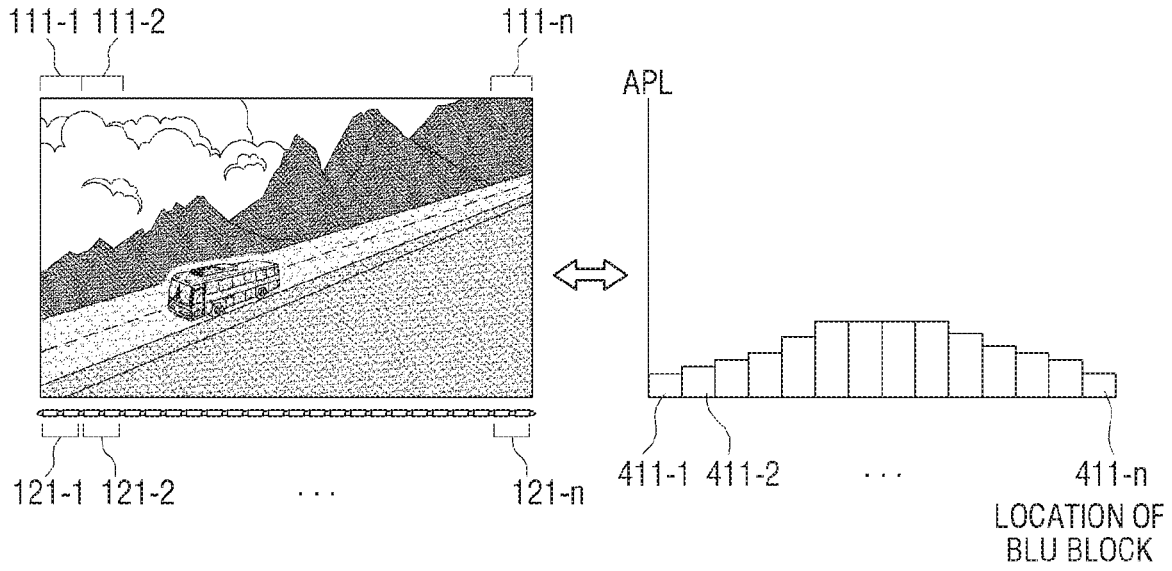
FIGS. 4A and 4B are diagrams illustrating methods for obtaining a current duty corresponding to each of backlight blocks, according to various embodiments.
Figure 4B:
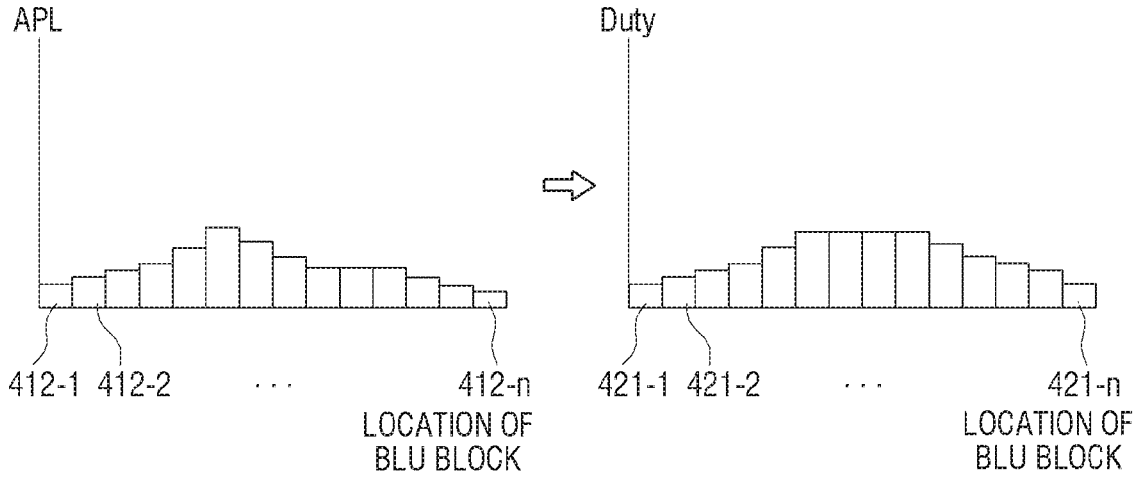

FIGS. 4A and 4B are diagrams illustrating a method for obtaining a current duty corresponding to each of backlight blocks (BLU), according to an embodiment;

In a case that the backlight unit 120 is implemented as an edge-type backlight unit 120-2 according to an embodiment, the processor 130 may obtain pixel information of the respective image areas to be displayed on screen areas respectively corresponding to the backlight blocks, for example, APL information, and calculate a current duty of a backlight block corresponding to a screen area on the basis of the obtained pixel information.

For example, the processor 130 may calculate APL information of the image areas 111-1 to **111-*n* respectively corresponding to the backlight blocks 121-1 to 121-*n* as illustrated on the right side of FIG. 4A. For example, in the left side of FIG. 4B, a case where an APL value 411-1 to 411-*n* of the respective image areas 111-1 to 111-*n* of the respective image areas 111-1 to 111-*n*** according to an embodiment is illustrated.

Subsequently, the processor 130 may, as illustrated in FIG. 4B, calculate a current duty 421-1 to **421-*n* of the respective backlight blocks 121-1 to 121-*n*. The current duties may be calculated on the basis of the APL value of the respective image areas obtained in FIG. 4A. For example, a predetermined weight may be applied to the APL value of the respective image areas and current duties of the respective backlight blocks 121-1 to 121-*n*** may be calculated. For example, a current duty of an image area of which an APL is 10% may be calculated as shown in 10%*6=60%, and a current duty of an image area of which an APL is 7% may be calculated as shown in 7%*6=42%. However, this is only an example of calculating a current duty, and the current duty may be calculated in various ways on the basis of pixel information of the respective screen areas.

According to an embodiment, the processor 130 may arrange current duties respectively corresponding to the respective backlight blocks according to an order of connection of the respective backlight blocks, and provide the arranged current duties to a local dimming driver. In this case, the local dimming driver may generate a pulse width modulation (PWM) signal with the respective current duties provided from the processor 130, and sequentially drive the respective backlight blocks on the basis of the generated PWM signal. According to an embodiment, the processor 130 may generate a PWM signal on the basis of the calculated current duty and provide the generated PWM signal to the local dimming driver.

According to an embodiment, the processor 130 may identify a motion blur occurrence area in an input image, adjust a current duty of at least one backlight block corresponding to the motion blur occurrence area, and adjust an intensity of a driving current on the basis of the adjusted current duty and drive the backlight unit 120. Herein, the motion blur refers to an image dragging phenomenon in which boundaries of a moving object are not distinguished from each other but look overlapped.

For example, the processor 130 may reduce a current duty of at least one backlight block corresponding to the motion blur occurrence area by a target duty, and increase the intensity of the driving current on the basis of the reduced current duty, and drive the backlight unit 120. Herein, the target duty may be set in consideration of an intensity of current applicable to the backlight block, etc. For example, in a case that an analog dimming, that is, a degradation of brightness due to reduction of duty by increasing an intensity of current, is to be compensated, an intensity of current applicable to the backlight block 120, etc., may be taken into account. However, in embodiments, the entire brightness degradation due to duty control may not be compensated, and thus it is possible to determine an appropriate target duty by enduring a certain level of brightness degradation.

In this case, the processor 130 may identify a motion blur occurrence area on the basis of at least one of motion information, image characteristic information or brightness information of the input image. Herein, the image characteristic information may include at least one of edge information and texture information.

The processor 130 may identify a plurality of image blocks of the input image, and identify a motion blur occurrence area on the basis of motion information, image characteristic information and brightness information of the respective image blocks.

For example, the processor 130 may obtain motion information, image characteristic information and brightness information from a particular image block, and obtain motion blur by applying a predetermined weight to the respective obtained information and then multiplying the information to which the weight is applied by one other. If the obtained motion blur information is greater than or equal to a threshold, the particular image block may be identified as a motion blur occurrence area.

Figure 5:
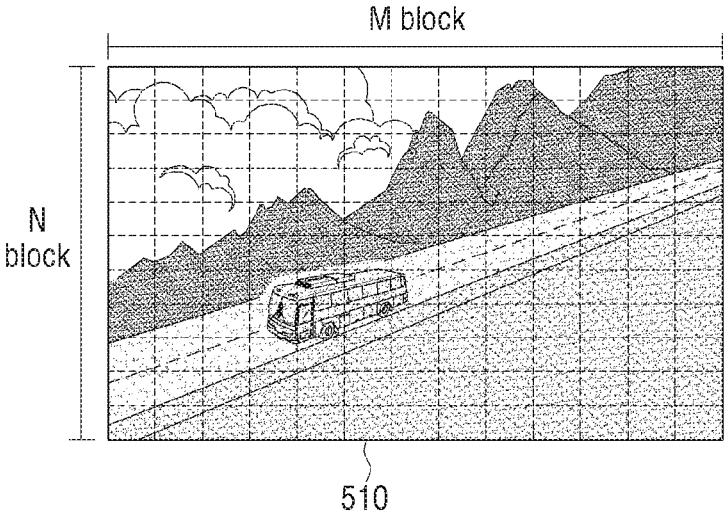
FIG. 5 is a diagram illustrating a method for identifying a motion blur occurrence area, according to an embodiment.

According to an embodiment, the processor 130 may, as illustrated in FIG. 5, identify an input image as an image block of a particular size. Subsequently, the processor 130 may obtain each of motion information, image characteristic information and brightness information from at least one image block. For example, the processor 130 may compare image blocks respectively corresponding to a plurality of image frames and obtain motion information (e.g., a motion vector). In addition, the processor 130 may obtain at least one of edge information and texture information on the basis of a pixel value of the respective image blocks. Herein, the texture refers to a unique pattern or shape of an area regarded to be the same texture from among an image. In addition, the processor 130 may obtain brightness information on the basis of pixel information (or gradation information) of the input image and a light emission characteristic of a display device included in the display panel 110.

Subsequently, the processor 130 may obtain motion blur information on the basis of the obtained motion information, the obtained image characteristic information and the obtained brightness information, and identify (or predict) a motion blur occurrence area on the basis of the motion blur information. Herein, the motion blur occurrence area may correspond to at least one backlight block area generated by division for local dimming. That is, if a size of an image block identified in an image frame is less than a size of the backlight block, a group of multiple image blocks may be identified as a motion blur occurrence area.

Figure 6A:
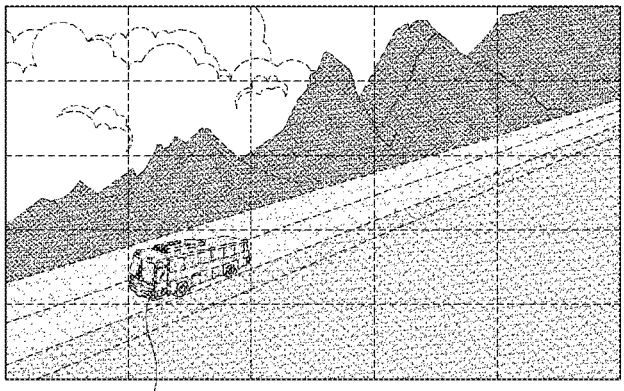
FIGS. 6A and 6B are diagrams illustrating methods for adjusting a duty and intensity of a current, according to various embodiments.
Figure 6B:
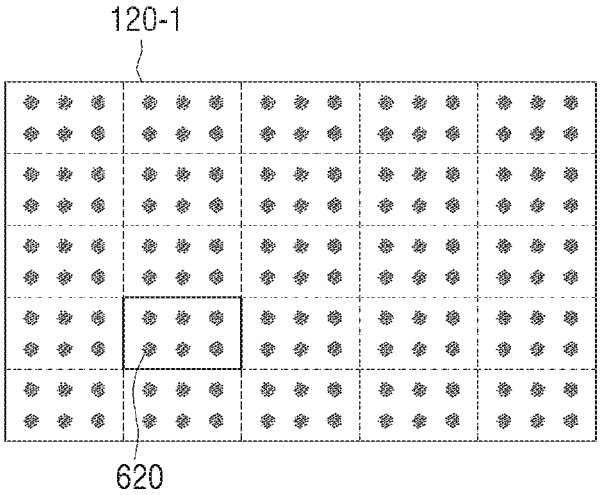

For example, when an area 610 is identified as the motion blur occurrence area as illustrated in FIG. 6A, as illustrated in FIG. 6B, a current duty of a backlight block 620 corresponding to the corresponding area may be adjusted and an intensity of a driving current may be adjusted on the basis of the adjusted current duty.

Figure 7A:
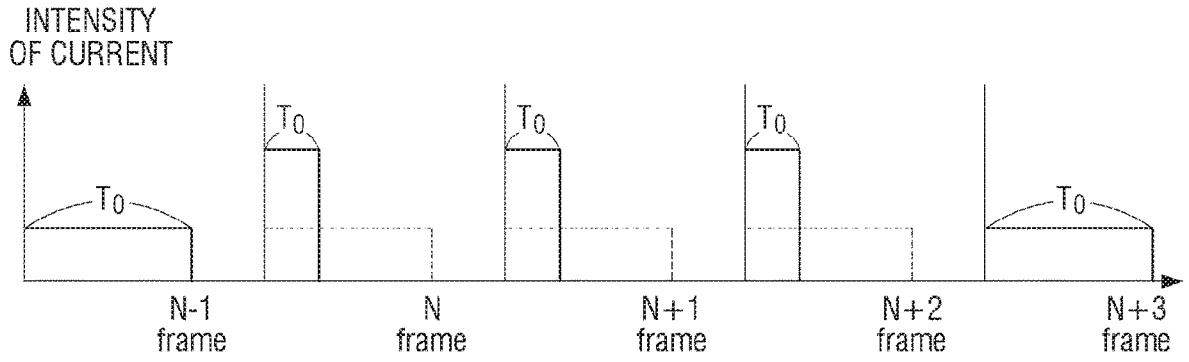
FIGS. 7A, 7B and 7C are diagrams illustrating methods for adjusting a duty and intensity of a current, according to various embodiments.
Figure 7B:
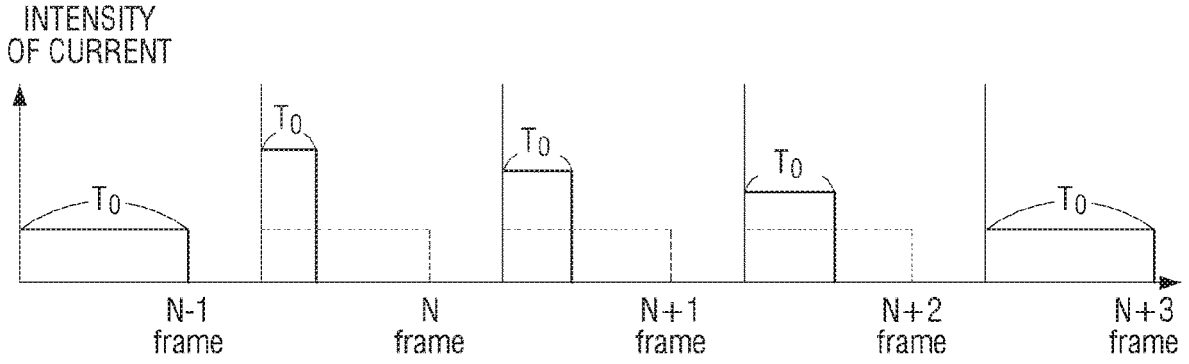
Figure 7C:
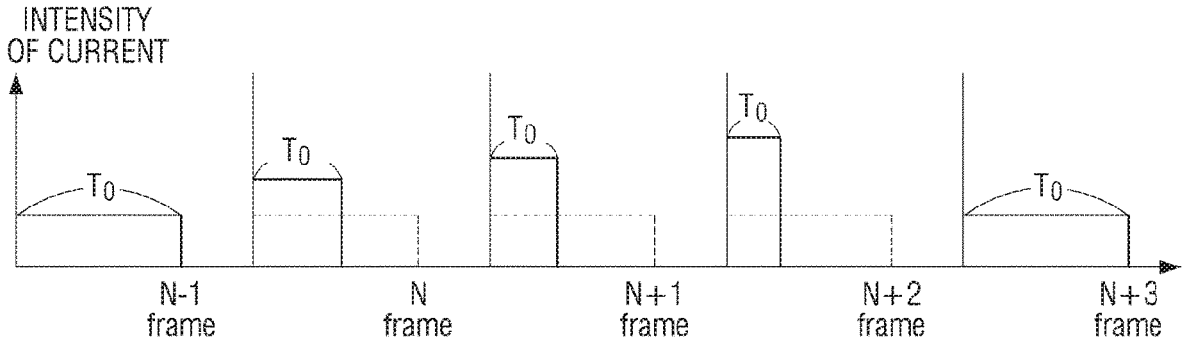

FIGS. 7A, 7B and 7C are diagrams illustrating methods for adjusting a duty and intensity of a current, according to various embodiments.

According to an embodiment, when it is identified that the area 610 illustrated in FIG. 6A is identified as a motion blur occurrence area in a current frame (Nth frame), the processor 130 may reduce a duty $T_0$ of the backlight block 620 by a target duty in the corresponding frame interval (N frame, N+1 frame, N+2 frame) as illustrated in FIG. 7A, and increase an intensity of driving current on the basis of the reduced amount of duty. Thereafter, the duty $T_0$ of the corresponding backlight block 620 may be restored in the frame (N+3 frame).

According to another embodiment, the processor 130 may, as illustrated in FIG. 7B, control the backlight unit 120 by reducing the duty $T_0$ of the backlight block 620 by a target duty in first some frames (N frames) from among the corresponding frame section (N frame, N+1 frame, N+2 frame), and then gradually increasing the duty $T_0$ of the backlight block 620 in the next frame. That is, the processor 130 may end the control for reduction of motion blur by gradually increasing the target duty at the time when the backlight control for reducing the motion blur is ended. In this case, as the duty $T_0$ of the backlight block 620 is gradually increased, the processor 130 may gradually reduce the intensity of driving current on the basis of the increased amount of duty.

According to another embodiment, the processor 130 may, as illustrated in FIG. 7C, control the backlight unit 120 by gradually increasing the backlight duty in the corresponding frame interval (N frame, N+1 frame, N+2 frame). That is, in a case that a target duty to reduce a motion blur is determined, the processor 130 may control the backlight block 620 by gradually reducing the backlight duty to the target duty rather than reducing it at once. In this case, with the gradual increase in the duty $T_0$ of the backlight block 620, the processor 130 may gradually increase the intensity of driving current on the basis of the decreased amount of duty.

The backlight block 620 may be controlled by combining the embodiments illustrated in FIGS. 7B and 7C. That is, the backlight block 620 may be driven at a target duty by gradually reducing the duty $T_0$, and thereafter, at the time when a backlight control for reducing motion blur of a backlight is ended, the target duty may be gradually increased. Thereby, the control for reduction of motion blur may be ended.

In the example described above, for convenience of explanation, a duty is respectively controlled for the N frame, the N+1 frame, and the N+2 frame. However, the corresponding duty control may be carried out in units of a plurality of frames. For example, as for an embodiment illustrated in FIG. 7B, when it is assumed that a duty control for motion blur reduction is performed for a period of 50 frames, the backlight block 620 may be driven by driving the backlight block 620 at a target duty for 45 frames and gradually increasing the backlight duty for the remaining 5 frames. For example, as for an embodiment illustrated in FIG. 7C, when it is assumed that a duty control for motion blur reduction is performed for a period of 50 frames, when the backlight duty is increased for the first 5 frames and reaches the target duty, the backlight block 620 may be driven at a target duty for the remaining 45 frames.

Figure 8:
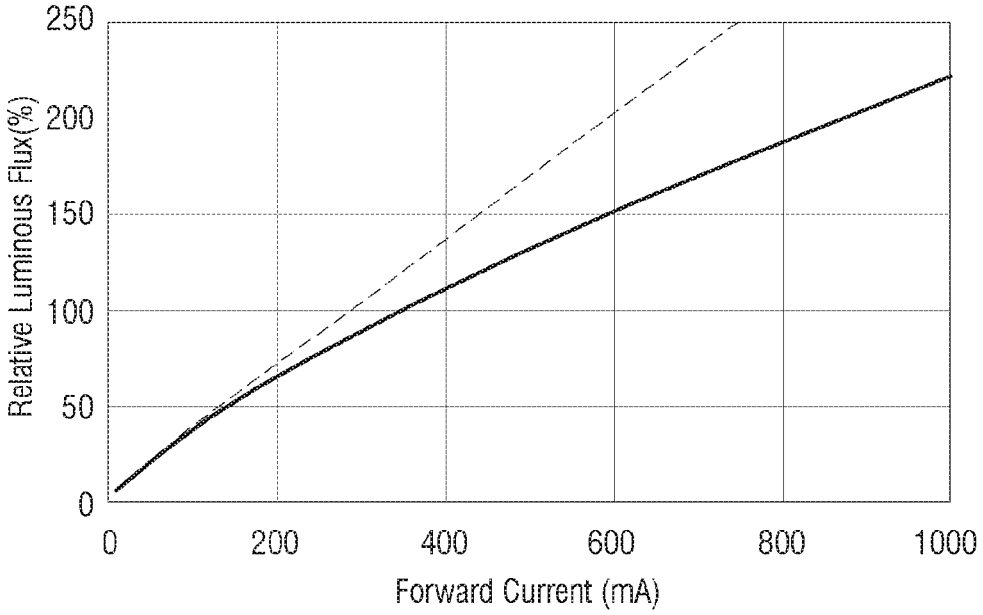
FIG. 8 is diagram illustrating a method for adjusting a duty and intensity of a current, according to various embodiments.

The processor 130 may reduce the duty $T_0$ of the backlight block 620, and calculate an increment of intensity of a driving current corresponding to the reduced duty amount based on a light emission characteristic (or brightness characteristic) of light emitting devices included in the backlight unit 120. For example, the light emitting devices included in the backlight unit 120 may provide a light emission characteristic as illustrated in FIG. 8. As shown, a brightness may not linearly increase as an intensity of current increases. Rather, an increase of brightness may slow down as current increases. Accordingly, the processor 130 may calculate an increment of intensity of a driving current corresponding to the reduced duty amount on the basis of a graph as illustrated in FIG. 8. Herein, the characteristic of the light emitting devices may be stored in a storage. For example, the characteristic may be stored in a graph form as illustrated in FIG. 8. However, this is only an example, and the characteristic may be stored in other forms such as a lookup table. The information may be stored in the storage at the time when the display apparatus 100 is manufactured, or may be received from an external apparatus, an external server, etc., and stored in the storage.

Figure 9A:
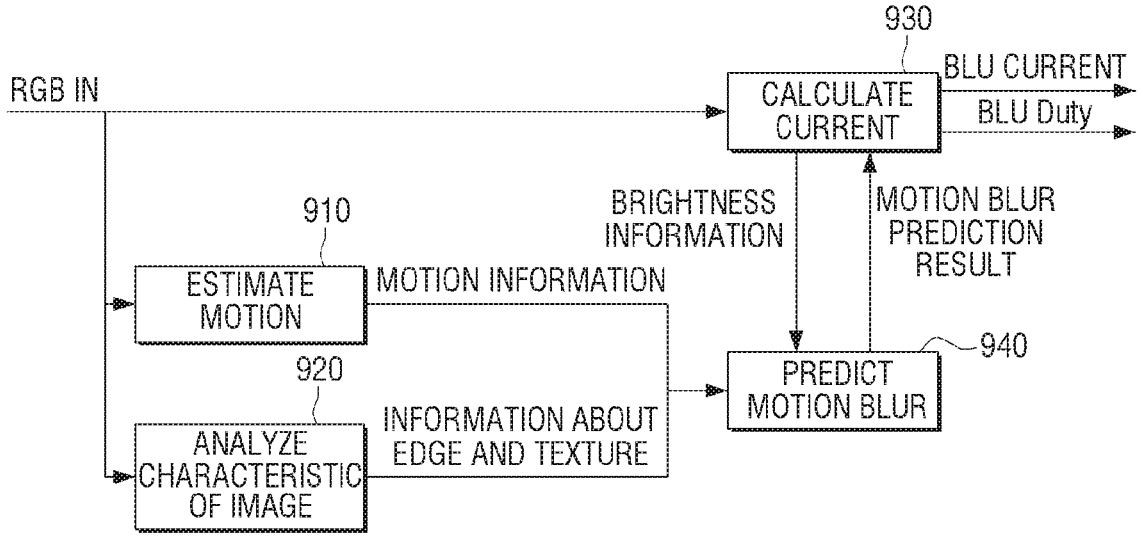
FIGS. 9A and 9B are diagrams illustrating methods for driving a backlight, according to various embodiments.

FIG. 9A is a diagram illustrating a method for driving a backlight, according to an embodiment.

Referring to FIG. 9A, the processor 130 may receive, at 940, motion information obtained through a movement estimation 910, edge and texture information obtained through the image characteristic analysis 920, and motion blur information on the basis of brightness information. Based on the received motion information, edge and texture information, and brightness information, the processor 130 may identify an amount of motion blur.

According to an embodiment, the processor 130 may calculate a motion blur value from each of the obtained motion information, the obtained edge and texture information, and the obtained brightness information, and obtain motion blur information by applying a predetermined weight to each of the calculated motion blur values and multiplying the motion blur value to which the weight has been applied by one another. For example, the motion blur value may be, for example, represented as a value in the range of 0 and 1. When it is assumed that a motion blur value caused by motion is $b_v$, that a motion blur value caused by image characteristic information, that is, an edge and a texture is $b_t$, and that a motion blur value caused by brightness information is $b_i$, the motion blur information b may be calculated by multiplying $b_v$, $b_t$ and $b_i$ together.

The motion blur value $b_v$ caused by motion has a positive correlation, which may be, in an implementation, represented as a proportional expression as shown in the next mathematical formula 1.

$$b_v=\min(1,w_vV) \quad \text{[Mathematical formula 1]}$$

where the V indicates an average movement of the respective block areas, and the $w_v$ indicates a proportional constant. The $w_v$ may be determined such that the $b_v$ equals 1 when the speed is at its maximum with which a human visual system can catch up, and may be determined through other experiments.

The motion blur value $b_t$ caused by edge and texture has a positive correlation, which may be, in an implementation, represented as a proportional expression as shown in the next mathematical formula 2.

$$b_t=\min(1,w_tT) \quad \text{[Mathematical formula 2]}$$

where the T indicates an intensity of edge and texture of the respective block areas, and the $w_t$ indicates a proportional constant. The $w_t$ may be determined such that the $b_t$ equals 1 with respect to a maximum T value which can be provided by an image signal, and may be determined through other experiments.

The motion blur value bi caused by brightness information, i.e., a brightness of display, has a positive correlation, which may be, in an implementation, represented as a proportional expression as shown in the next mathematical formula 3.

$$b_i=\min(1,w_iI) \quad \text{[Mathematical formula 3]}$$

where the I indicates a current brightness setting of a display, and the $w_i$ indicates a proportional constant. The $w_i$ may be determined such that the $b_i$ equals 1 with respect to a maximum brightness value of a display apparatus, and may be determined through other experiments.

When motion blur information b is calculated, the processor 130 may calculate an optimum PWM dimming signal and driving current for each backlight block for local dimming on the basis of the motion blur information b.

For example, in order to reduce a motion blur, a time for which a backlight is turned on may be reduced with the increase in the motion blur information, and thus the processor 130 may control a ratio $t_{on}$ of a time corresponding to an on state from among the PWM dimming signal to be a value between 0 to 1, and may control to have a negative correlation with an amount of motion blur (b).

An embodiment may be expressed as shown in a proportional expression of the following mathematical formula 4.

$$t_{on}=\max(t_m,1-b) \quad \text{[Mathematical formula 4]}$$

In the mathematical formula 4, $t_{on}$ is a value less than 1 and the time for which the backlight is turned on reduces. Thus, to maintain the brightness, the driving current may be increased correspondingly. Herein, a value of increment of driving current may be calculated in accordance with a device characteristic so that the backlight device may maintain the same brightness. The $t_i$ indicates a ratio of a minimum lighting time of the backlight so that the display apparatus 100 may maintain the brightness of the display through increase of a current.

However, the mathematical formula 4 is only an example, and various relational expressions in which the motion blur information b and the $t_{on}$ have a negative correlation.

When the $t_{on}$ is determined on the basis of the motion blur information, the processor 130 may compare the determined $t_{on}$ with the determined backlight duty $t_0$ on the basis of pixel information of an image and perform an analog dimming. For example, if the backlight duty $t_0$ determined on the basis of the pixel information of the image is less than the $t_{on}$ determined on the basis of the motion blur information, the $t_0$ may be used to maintain an applied current. If the $t_0$ is greater than the $t_{on}$, the $t_{on}$ may be used and the applied current may be increased to have the same brightness as when the $t_0$ is used.

Figure 9B:
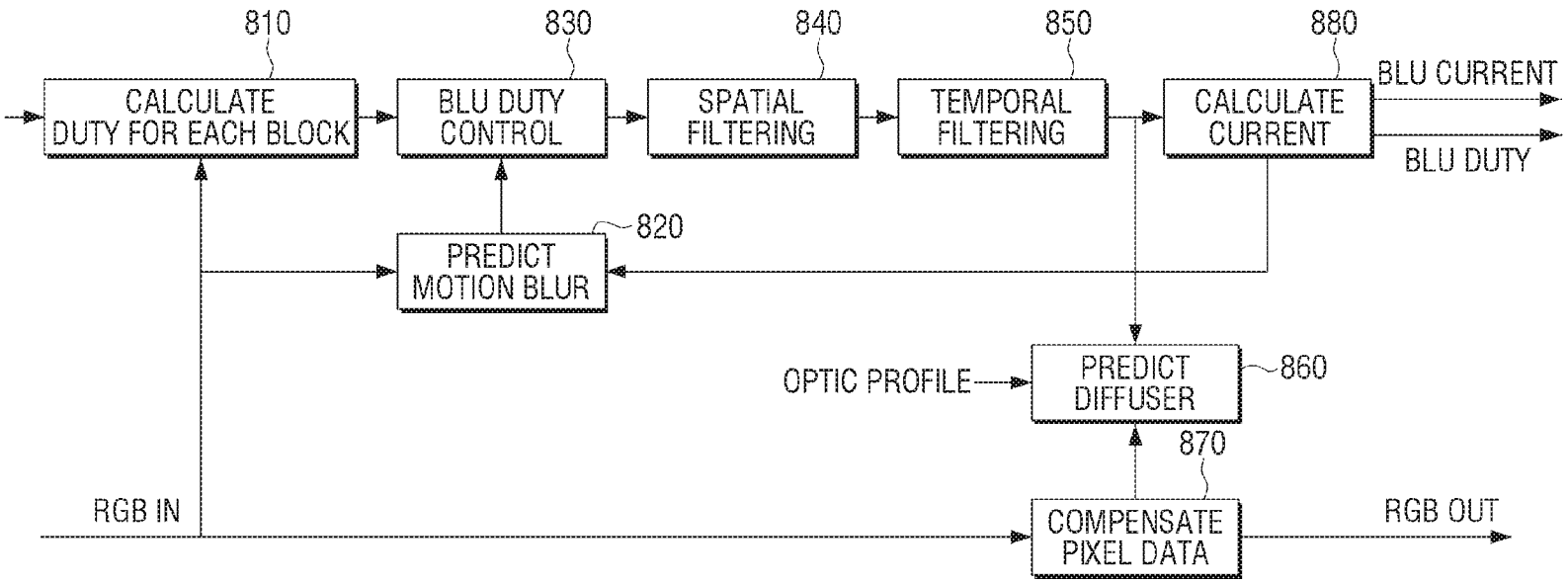

FIG. 9B is a diagram illustrating a method for driving a backlight, according to another embodiment.

According to an embodiment, the processor 130 may calculate a current duty for each backlight block on the basis of an input image, at 810. For example, the processor 130 may, on the basis of RGB pixel information of an image area corresponding to the respective backlight block in a current image frame, calculate a current duty for each backlight block.

Subsequently, the processor 130 may predict a motion blur occurrence area at 820, and adjust a current duty of a backlight block corresponding to the predicted area at 830. Herein, when the motion blur occurrence area is predicted, brightness information, that is, brightness information of the display panel 110, may be necessary. Accordingly, the sequence of blocks 810, 820, 830, 840, 850, 860, 870 and 880 is an example, and an operation of the respective blocks may be variously connected or modified according to embodiments.

The processor 130 may perform a spatial filtering for reducing a difference of dimming between the respective backlight blocks, at 840.

When the local dimming is performed, a halo phenomenon may occur due to the difference of dimming between the respective backlight blocks. In order to prevent this phenomenon from occurring, according to an embodiment, the processor 130 may perform a spatial filtering (or duty spread adjustment) for a current duty for each block to relieve the difference of dimming between the respective backlight blocks. For example, the processor 130 may adjust a current duty of the corresponding block on the basis of a current duty of a peripheral block of the respective backlight blocks. For example, a current duty of a current block may be adjusted using a method of applying a spatial filter including a window of a particular size (e.g., 3×3 size) by assigning a particular weight to a current duty of each of eight blocks adjacent right and left and top and bottom to a current duty of a current block, and thereby the dimming difference between the adjacent blocks can be relieved.

In addition, the processor 130 may perform a temporal filtering to reduce a difference of brightness due to a change of image, at 850.

In general, when the local dimming is performed, a flicker phenomenon may occur due to a difference of brightness according to a change of image. To prevent such a phenomenon, according to an embodiment, a temporal filtering may be performed so that a brightness shift of the backlight unit 120 according to an image frame occurs smoothly. For example, the processor 130 may compare a Nth dimming data corresponding to the current frame with a (N−1)th dimming data corresponding to the previous frame, and perform the filtering so that a brightness shift of the backlight unit 120 slowly occurs over a predetermined time according to the comparison result. Then, the backlight unit 120 may be driven by calculating a current corresponding to a dimming data calculated through the temporal filtering, at 880.

In addition, the processor 130 may compensate the pixel data on the basis of an optic profile of the backlight unit 120. For example, the processor 130 may analyze an optic profile of a backlight light source and identify an optical diffuser, at 80, and compensate pixel data on the basis of the identification result, at 870. Depending on circumstances, the processor 130 may compensate the pixel data on the basis of a backlight duty reduced according to an embodiment.

According to an embodiment, some of the operations of the blocks 810, 820, 830, 840, 850, 860, 870 and 880 may be omitted, or a new operation may be added.

Figure 10A:
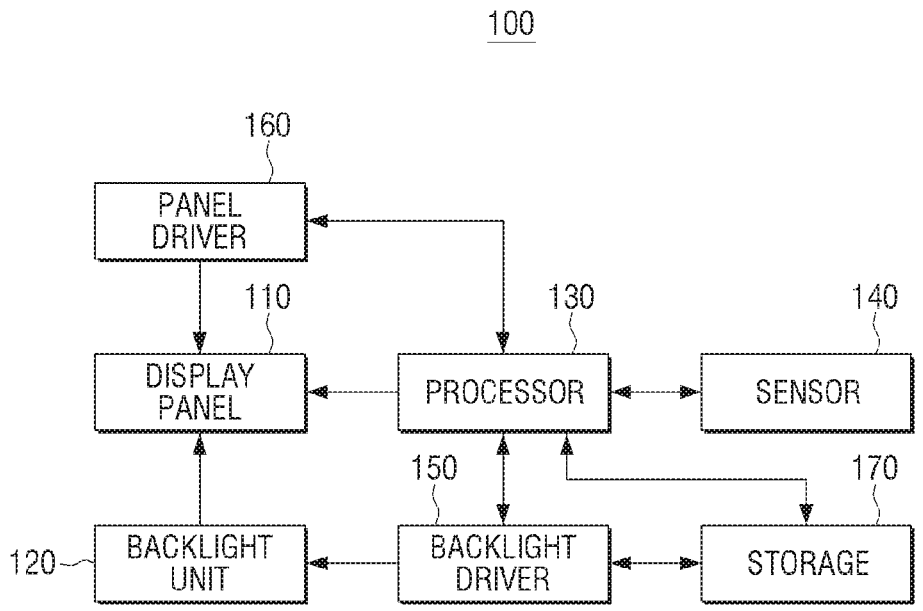
FIGS. 10A and 10B are diagrams illustrating detailed configurations of a display apparatus, according to various embodiments.
Figure 10B:
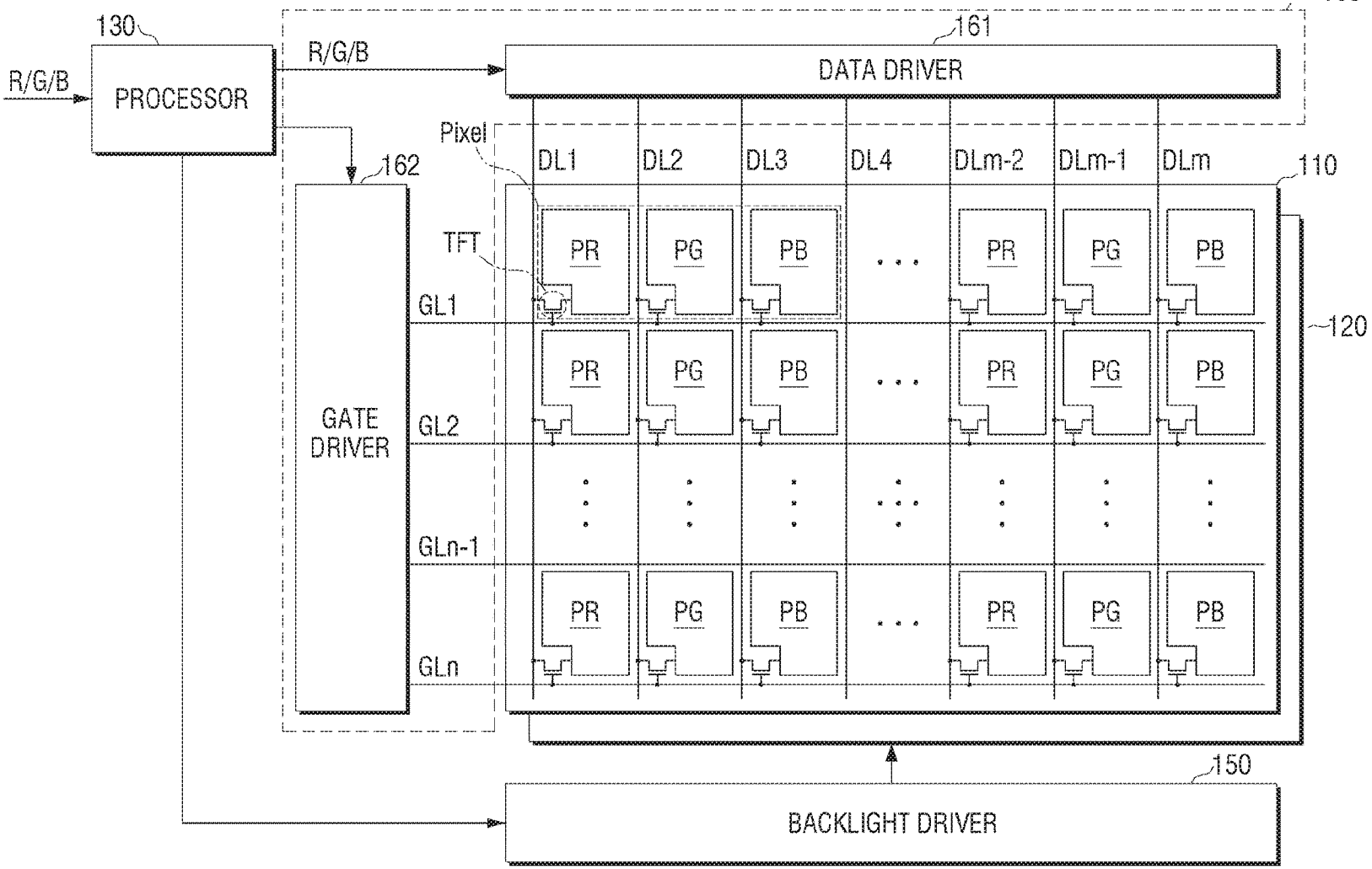

FIGS. 10A and 10B are diagrams illustrating a detailed configuration of a display apparatus, according to an embodiment.

According to FIG. 10A, the display apparatus 100 may include a display panel 110, a backlight unit 120, a processor 130, a sensor 140, a backlight driver 150, a panel driver 160, and a storage 170. Description of elements discussed above with reference to FIG. 2 will not be repeated.

The sensor 140 may sense an external light.

For example, the sensor 140 may detect at least one of various characteristics such as illumination, intensity, color, entering direction, entering area, and distribution of light. According to an embodiment, the sensor 140 may be an illumination sensor, a temperature sensor, a light sensing layer, or a camera. For example, the sensor 140 may be implemented as an illumination sensor sensing visible light. However, the present disclosure is not limited thereto, and the sensor 140 may be any apparatus capable of performing an optical sensing, such as a white sensor, Infrared (IR) sensor, IR+RED sensor, heart rate monitor (HRM) sensor, camera, and the like.

According to some embodiments, one sensor 140 may be provided. According to other embodiments, a plurality of sensors 140 may be provided. When a plurality of sensors 140 are provided, the plurality of sensors 140 may be disposed at different positions to sense illumination of different directions. For example, a second sensor may be provided at a position to sense an illumination which differs more than 90° from the sensing direction of a first sensor. For example, the sensor 140 may be disposed inside a glass provided on the display panel 110.

The processor 130 may adjust a current duty for each backlight block on the basis of an intensity of a sensed external light.

As shown in FIG. 10B, the display panel 110 is formed so that the gate lines GL1 to GLn and the data lines DL1 to DLm intersect with each other, and that R, G, and B sub-pixels PR, PG, and PB are formed at the intersections thereof. Adjacent R, G, and B subpixels PR, PG, and PB form one pixel. That is, each pixel includes an R subpixel PR representing red, a G subpixel PG representing green, and a B subpixel PB representing blue.

In a case that the display panel 110 is implemented as an LCD panel, the respective subpixels PR, PG and PB may include a pixel electrode and a common electrode. An arrangement of liquid crystals may be changed to an electric film formed with a difference of potential between the opposite electrodes. Thin film transistors (TFTs) formed at an intersection of gate lines GL1 to GLn and data lines DL1 to DLm may, in response to a scan pulse from the gate lines GL1 to GLn, respectively supply video data, i.e., red (R), green (G) and blue (B) data, from the data lines DL1 to DLm to a pixel electrode of the respective sub-pixels PR, PG and PB.

The backlight driver 150 may be implemented to include a driver IC for driving the backlight unit 120. For example, a driver IC may be implemented as a hardware separate from the processor 130. For example, in a case that light sources included in the backlight unit 120 are implemented as an LED device, the driver IC may be implemented as at least one LED driver controlling a current applied to the LED device. According to an embodiment, the LED driver may be disposed at the rear end of the power supply (e.g., SMPS), and receive a voltage from the power supply. However, according to another embodiment, the LED driver may receive a voltage from a separate power supply device. Alternatively, it is also possible that the SMPS and the LED driver are realized in the form of one integrated module.

The panel driver 160 may be implemented to include a driver IC for driving the display panel 110. For example, the driver IC may be implemented as a hardware separate from the processor 130. For example, the panel driver 160 may include a data driver 161 for supplying video data to data lines, and a gate driver 162 for supplying a scan pulse to gate lines.

The data driver 161 generates a data signal. The data driver 122 may receive image data of an R/G/B component from the processor 130 (or timing controller) and generate a data signal. The data driver 161 applies data signals generated in connection with the data lines DL1, DL2, DL3, . . . , DLm of the display panel 110 to the display panel 110.

The gate driver 162 (or scan driver) generates a gate signal (or scan signal). The gate driver 123 is connected to the gate lines GL1, GL2, GL3, . . . , GLn to transmit the gate signal to a column of the display panel 110. The data signal output from the data driver 161 is transmitted to the pixel to which the gate signal is transmitted.

In addition, the panel driver 160 may further include a timing controller. The timing controller may receive, from an external source, e.g., the processor 130, an input signal IS, a horizontal synchronizing signal Hsync, a vertical synchronizing signal Vsync and a main clock signal MCLK from the outside, and generate an image data signal, a scanning control signal, a data control signal, a data control signal, a light emission control signal, and the like to the display panel 110 and provide the generated signals to the display panel 110, the data driver 161, the gate driver 162, and the like.

The storage 170 may store various data required for an operation of the display apparatus 100.

For example, the storage 170 may store data for the processor 130 to execute various processing. For example, the storage 170 may be realized as an internal memory such as read-only memory (ROM), random-access memory (RAM) and the like included in the processor 130, and may be realized as a separate memory from the processor 130. In this case, the storage 170 may be realized in the form of a memory embedded in the display apparatus 100, or may be realized in the form of a memory that may be detached from the display apparatus 100 according to the usage of data storage. For example, data for driving the display apparatus 100 is stored in a memory embedded in the display apparatus, and data for an extension function of the display apparatus 100 may be stored in a memory that may be detached from the display apparatus 100. The memory embedded in the display apparatus 100 may be realized in the form of a non-volatile memory, volatile memory, flash memory, hard disk drive (HDD), solid state drive (SDD), or the like, and the memory that may be detached from the display apparatus 100 may be realized in the form of a memory card (e.g., micro SD card, universal serial bus (USB) memory), an external memory that is connectable to a USB port (e.g. USB memory), and the like.

According to another embodiment, the above-mentioned information (for example, current adjustment curve, pixel data compensation curve, etc.) may not be stored in the storage 170, but may be obtained from an external apparatus. For example, some information may be received from an external apparatus, such as a set-top box, external server, user terminal, and the like, in real time.

Figure 11A:
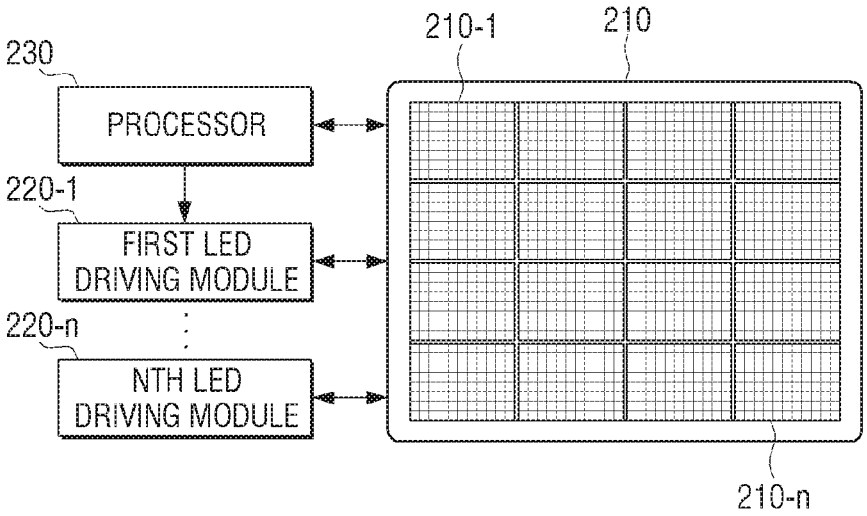
FIGS. 11A and 11B are diagrams illustrating methods for driving a display apparatus, according to various embodiments.
Figure 11B:
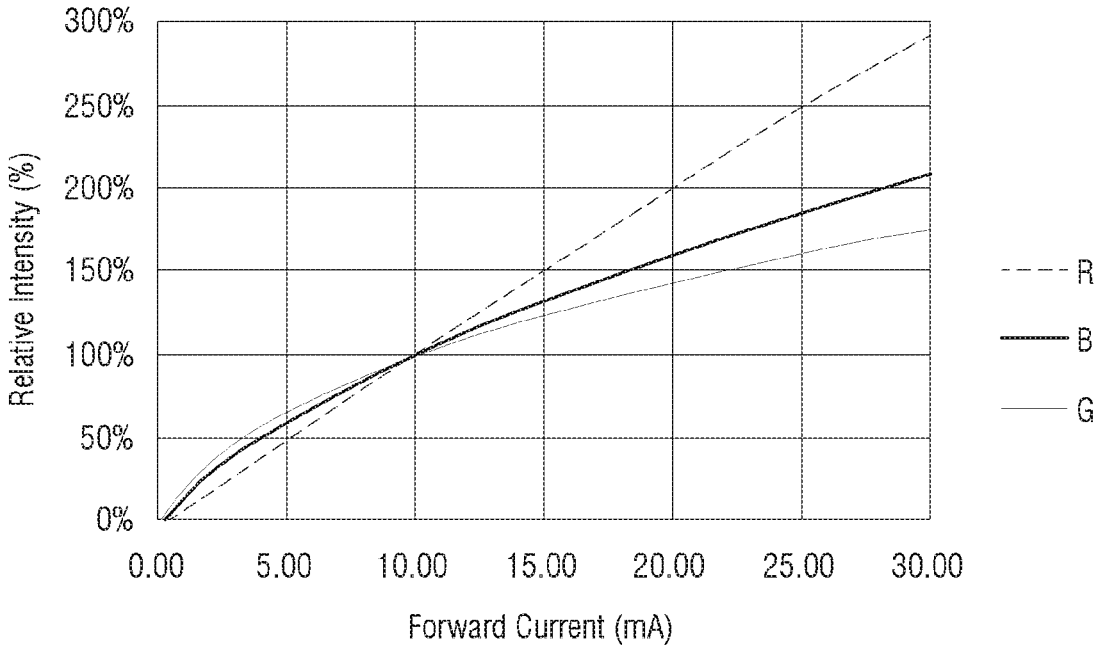
Figure 12:
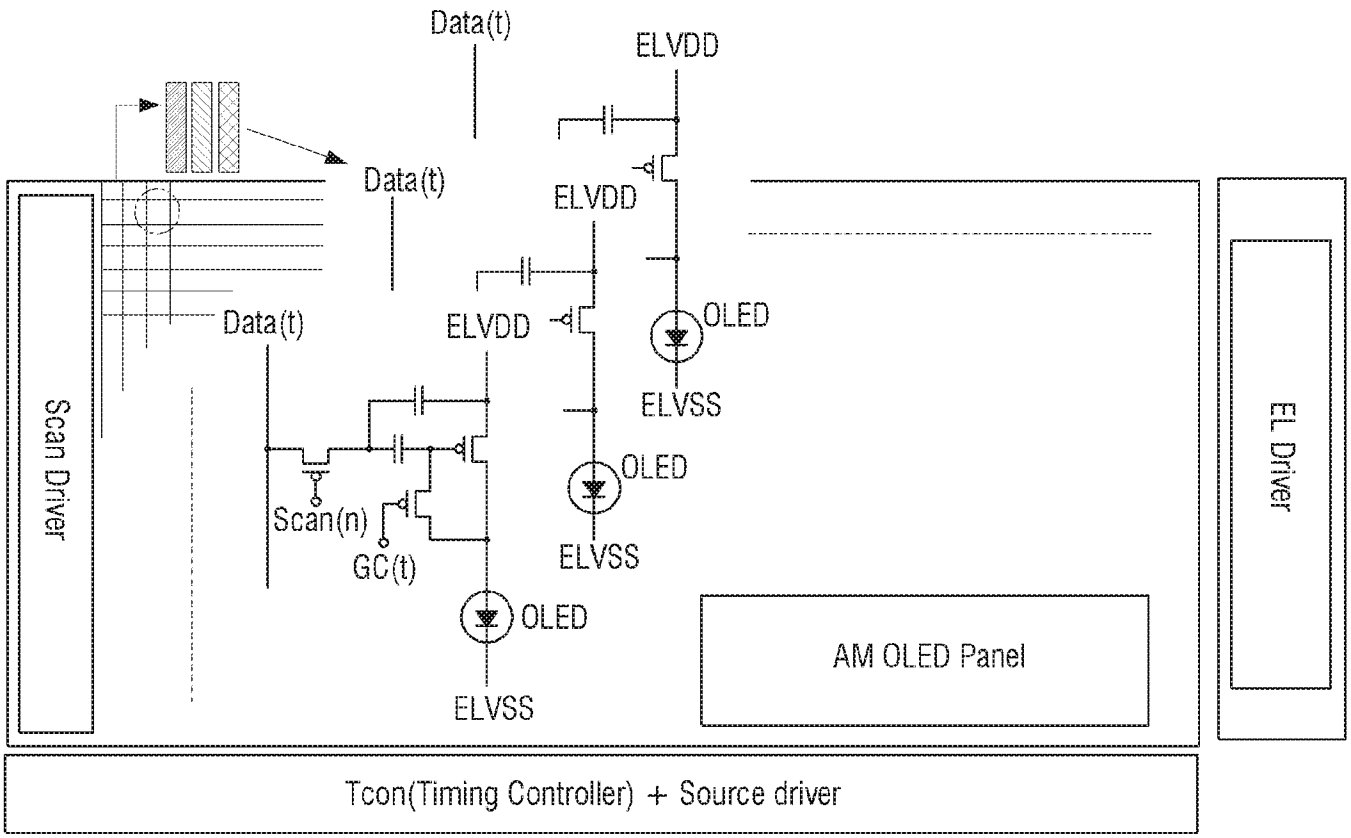
FIG. 12 is diagram illustrating a method for driving a display apparatus, according to various embodiments.

FIGS. 11A, 11B and 12 are diagrams illustrating a method for driving a display apparatus, according to various embodiments.

The various embodiments described above may be applicable the same way not only to LCD panels but also to display apparatuses utilizing a self-emitting-type device, such as an organic light emitting diode (OLED) panel, an LED panel, or the like.

FIGS. 11A and 11B are diagrams illustrating a case where embodiments of the disclosure are applied to an LED display apparatus. The LED display apparatus 200 is a display apparatus using an LED device as a light emitting pixel, which may be implemented in a form that a plurality of display modules 210-1, . . . , 210-*n* are physically connected as illustrated in FIG. 11A. In this case, each of the plurality of display modules may include a number of pixels arranged in a matrix form, for example, LED pixels. Specifically, the display apparatus module may be implemented as an LED module in which each of a number of pixels is realized as an LED pixel, or an LED cabinet in which a plurality of LED modules are connected to each other, but the present disclosure is not limited thereto. The display driver 220 may include a plurality of LED driving modules 220-1, . . . , 220-*n* respectively connected to a plurality of display modules 210-1, . . . , 210-*n*. The plurality of LED driving modules 220-1, . . . , 220-*n* supplies a driving current to the plurality of display modules 210-1, . . . , 210-*n* to correspond to each control signal input from the processor 130 to drive the plurality of display modules 210-1, . . . , 210-*n*. Specifically, the plurality of LED driving modules 220-1, . . . , 220-*n* may regulate a supply time or an intensity of a driving current that is supplied to the plurality of display modules 210-1, . . . , 210-*n* to correspond to each control signal input from the processor 230 and output the same. The processor 230 may, as described above, identify a motion blur occurrence area in an input image, identify at least one display module corresponding to the motion blur occurrence area, reduce a supply time of a driving current supplied to an LED driving module corresponding to the corresponding display module, and increase an intensity of driving current to compensate an amount of reduction of brightness according to the reduced time. Other various embodiments may be applicable in the same way, and thus the detail will be omitted herein.

FIG. 12 is a diagram illustrating a case where the embodiments of the disclosure are applied to an OLED display apparatus.

As illustrated in FIG. 12, an Active Matrix Organic Light Emitting Diode (AM-OLED) display panel may include an RGB pixel cell including a TFT device and an organic electroluminescence (EL) device. Herein, the TFT driving may be performed through a timing controller, a scan driver, and a source driver, and may provide a function such as recording image information to be displayed, etc. In addition, an Active Matrix driving may be performed using a TFT inside the pixel, and a Vth compensation and a data recording may be performed through an external switch. In addition, when a light is actually emitted, the external switch may be connected to a power supply and an energy for light emission may be supplied.

As described above, a motion blur occurrence area may be identified in an input image, a pixel area corresponding to the motion blur occurrence area may be identified, a time for which a driving current is supplied to an OLED device included in the corresponding pixel area may be reduced, and an intensity of driving current may be reduced so that an amount of reduction of brightness due to the reduced time may be increased. Other various embodiments may be applicable in the same way, and thus the detail will be omitted herein.

Figure 13:
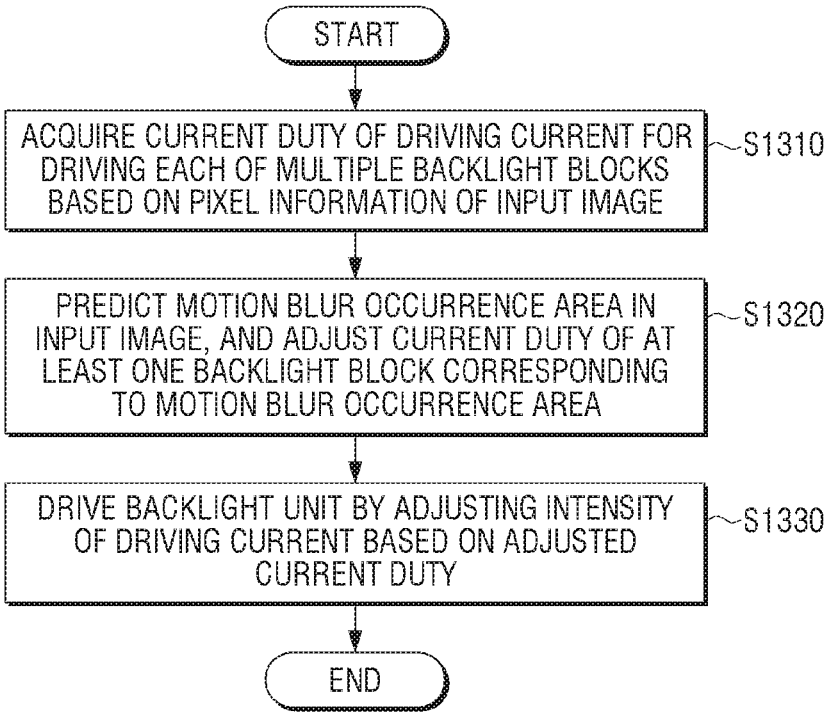
FIG. 13 is a flowchart illustrating a method for controlling a display apparatus, according to an embodiment.

FIG. 13 is a flowchart illustrating a method for controlling a display apparatus, according to an embodiment.

According to a method for driving a display apparatus illustrated in FIG. 13, a current duty of a driving current for driving each of a plurality of backlight blocks may be obtained at operation S1310.

Thereafter, a motion blur occurrence area may be identified in an input image, at operation S1320.

Then, a backlight unit may be driven by adjusting a current duty of at least one backlight block corresponding to the motion blur occurrence area and adjusting an intensity of driving current on the basis of the adjusted current duty, at operation S1330.

Herein, the operation S1330 to drive the backlight unit may include reducing a current duty of at least one backlight block corresponding to the motion blur occurrence area, and increasing an intensity of a driving current on the basis of the reduced current duty.

In addition, the operation S1320 to identify the motion blur occurrence area may include identifying the motion blur occurrence area on the basis of motion information, image characteristic information and brightness information of the input image. Herein, the image characteristic information may include at least one of edge information and texture information.

In addition, the operation S1320 to identify the motion blur occurrence area may include obtaining pixel information of the input image, and brightness information on the basis of light emission characteristics of a display device included in the display panel.

In addition, the operation S1320 to identify the motion blur occurrence area may include identifying the input as a plurality of block areas, and identifying the motion blur occurrence area on the basis of motion information, image characteristic information and brightness information of the respective block areas.

In addition, the operation S1320 to identify the motion blur occurrence area may include obtaining motion information, image characteristic information and brightness information from a particular block area of the input image, obtaining motion blur information on the basis of the obtained motion information, the obtained image characteristic information and the obtained brightness information, and identifying a motion blur occurrence area on the basis of the motion blur information.

In addition, the operation S1320 to identify the motion blur occurrence area may include calculating a motion blur value from each of the motion information, the image characteristic information and the brightness information, and obtaining motion blur information by applying a weight to the respective motion blur values and then multiplying the motion blur values to which the weight has been applied by one another.

In addition, the operation S1330 to drive the backlight unit may include driving the backlight unit by gradually reducing a current duty in a frame interval including a motion blur occurrence area and gradually increasing an intensity of driving current.

In addition, the operation S1310 to obtain the current duty may include obtaining a current duty of a driving current for driving each of the plurality of backlight blocks on the basis of pixel information of the input image.

As described above, according to an embodiment, it is possible to reduce a motion blur and flicker phenomenon by local dimming.

In the method for driving the backlight according to an embodiment, a PWM signal may be measured by, for example, an optical probe sensor, an oscilloscope, and the like. For example, when it is measured that a dimming duty of a PWM signal is reduced in some areas of an image and an intensity of current is increased, it may be considered that an embodiment of the disclosure has been applied. For example, when it is measured that a dimming duty of a PWM signal is reduced in an area with large motion information, large edge and texture information, and large brightness information and an intensity of current is increased, it may be considered that an embodiment of the disclosure has been applied.

In the embodiment described above, a current duty for backlight dimming is, for example, calculated by a display apparatus. However, depending on circumstances, the current duty may be calculated by an additional image processing apparatus not including a display panel. For example, the image processing apparatus may be implemented as various apparatuses capable of performing an image processing such as a set-top box, a sending box and the like, to provide an image signal to an image signal.

The methods according to the above-described embodiments may be realized as applications that may be installed in the existing electronic apparatus.

The methods according to various embodiments of the present disclosure described above can be implemented in an existing electronic apparatus by a software or hardware upgrade.

The above-described embodiments may be executed through an embedded server provided in an electronic apparatus or through at least one external apparatus from among the electronic apparatus and a display apparatus.

Meanwhile, the various embodiments described above may be implemented as a software program including one or more instructions stored on machine-readable (e.g., computer-readable) storage media. The machine is an apparatus which is capable of calling a stored instruction from the storage medium and operating according to the called instruction, and may include an electronic apparatus (e.g., an electronic apparatus A) according to the above-described embodiments. When the one or more instructions are executed by a processor, the processor may perform a function corresponding to the instruction directly or using other components under the control of the processor. The one or more instructions may include a code made by a compiler or a code executable by an interpreter. A machine-readable storage medium may be provided in the form of a non-transitory storage medium. Herein, the term "non-transitory" only denotes that a storage medium does not include a signal but is tangible, and does not distinguish the case where a data is semi-permanently stored in a storage medium from the case where a data is temporarily stored in a storage medium.

According to an embodiment, the method according to the various embodiments described above may be provided as being included in a computer program product. The computer program product may be traded as a product between a seller and a consumer. The computer program product may be distributed online in the form of machine-readable storage media (e.g., compact disc read only memory (CD-ROM)) or through an application store (e.g., Play Store™). In the case of online distribution, at least a portion of the computer program product may be at least temporarily stored or temporarily generated in a server of the manufacturer, a server of the application store, or a storage medium such as memory.

The respective components (e.g., module or program) according to the various embodiments may include a single entity or a plurality of entities, and some of the corresponding sub-components described above may be omitted, or another sub-component may be further added to the various embodiments. Alternatively or additionally, some components (e.g., module or program) may be combined to form a single entity which performs the same or similar functions as the corresponding elements before being combined. Operations performed by a module, a program, or other component, according to various embodiments, may be sequential, parallel, or both, executed iteratively or heuristically, or at least some operations may be performed in a different order, omitted, or other operations may be added.

The foregoing embodiments and advantages are merely exemplary and are not to be construed as limiting the present disclosure. The present teaching may be readily applied to other types of devices. Also, the description of the embodiments of the present disclosure is intended to be illustrative, and not to limit the scope of the claims, and many alternatives, modifications, and variations will be apparent to those skilled in the art.

What is claimed is:

1. A display apparatus, comprising:

a display panel;

a backlight including a plurality of backlight blocks; and a processor configured to:

identify a duty cycle of a driving signal for driving each of the plurality of backlight blocks;

drive the backlight based on the duty cycle of the driving signal;

obtain motion information, image characteristic information and brightness information from at least one block area of a plurality of block areas of an input image, the image characteristic information comprising at least one of edge information and texture information;

obtain motion blur information using the motion information, the image characteristic information and the brightness information and identify a motion blur occurrence area based on the motion blur information;

based on a motion blur occurrence area being identified, identify an adjusted duty cycle by adjusting the duty cycle of at least one backlight block from among the plurality of backlight blocks that corresponds to the motion blur occurrence area; and identify an adjusted current of the driving signal with the adjusted duty cycle and drive the backlight with the adjusted duty cycle and the adjusted current, wherein the processor is further configured to obtain the motion blur information by:

calculating a first motion blur value based on the motion information, calculating a second motion blur value based on the image characteristic information and calculating a third motion blur value based on the brightness information, applying a first weight to the first motion blur value, a second weight to the second motion blur value and a third weight to the third motion blur value, and multiplying the first motion blur value, the second motion blur value and the third motion blur value with each other after the first weight, the second weight and the third weight are respectively applied to the first motion blur value, the second motion blur value and the third motion blur value.

2. The display apparatus as claimed in claim 1, wherein the processor is further configured to reduce the duty cycle of the at least one backlight block corresponding to the motion blur occurrence area and increase the current of the driving signal.

3. The display apparatus as claimed in claim 1, wherein the processor is further configured to identify the brightness information based on pixel information of the input image and a light emission characteristic of the display panel.

4. The display apparatus as claimed in claim 1, wherein the processor is further configured to:

identify a plurality of block areas of the input image; and identify the motion blur occurrence area based on motion information, image characteristic information and brightness information of each of the plurality of block areas.

5. The display apparatus as claimed in claim 1, wherein the processor is further configured to drive the backlight by sequentially reducing the duty cycle for each of the plurality of frame intervals of the motion blur occurrence area and sequentially increasing the current of the driving signal for the respective frame interval.

6. The display apparatus as claimed in claim 1, wherein the display panel is a liquid crystal panel.

7. A method for driving a display apparatus including a display panel and a backlight which includes a plurality of backlight blocks, the method comprising:

identifying a duty cycle of a driving signal for driving each of the plurality of backlight blocks;

driving the backlight with the duty cycle of the driving signal;

obtaining motion information, image characteristic information and brightness information from at least one block area of a plurality of block areas of an input image, the image characteristic information comprising at least one among edge information and texture information;

obtaining motion blur information using the motion information, the image characteristic information and the brightness information;

identifying a motion blur occurrence area based on the motion blur information;

based on a motion blur occurrence area being identified, identifying an adjusted duty cycle by adjusting the duty cycle of at least one backlight block from among the plurality of backlight blocks that corresponds to the motion blur occurrence area;

identifying an adjusted current of the driving signal with the adjusted duty cycle; and driving the backlight with the adjusted duty cycle and the adjusted current, wherein the motion blur information is obtained by:

calculating a first motion blur value based on the motion information, calculating a second motion blur value based on the image characteristic information and calculating a third motion blur value based on the brightness information, applying a first weight to the first motion blur value, a second weight to the second motion blur value and a third weight to the third motion blur value, and multiplying the first motion blur value, the second motion blur value and the third motion blur value with each other after the first weight, the second weight and the third weight are respectively applied to the first motion blur value, the second motion blur value and the third motion blur value.

8. The method as claimed in claim 7, wherein the driving the backlight comprises:

reducing the duty cycle of the at least one backlight block corresponding to the motion blur occurrence area; and increasing a current of the driving signal to identify the adjusted current.

9. The method as claimed in claim 7, wherein the identifying the motion blur occurrence area comprises identifying the brightness information based on pixel information of the input image and a light emission characteristic of the display panel.

10. The method as claimed in claim 7, wherein the identifying the motion blur occurrence area comprises:

identifying a plurality of block areas of the input image; and identifying the motion blur occurrence area based on motion information, image characteristic information and brightness information of each of the plurality of block areas.

11. An apparatus comprising:

an interface configured to receive an image signal;

a backlight driver configured to drive a plurality of backlight blocks of a backlight; and a processor configured to:

identify a first block from among the plurality of backlight blocks corresponding to a motion blur occurrence area in the image signal; and control the backlight driver to drive the first block at a first voltage level and a first duty cycle, and drive a second block from among the plurality of backlight blocks at a second voltage level and a second duty cycle, wherein the processor is further configured to:

obtain motion information, image characteristic information and brightness information from at least one block area of a plurality of block areas of the image signal, the image characteristic information comprising at least one of edge information and texture information; and obtain motion blur information using the motion information, the image characteristic information and the brightness information and identify the motion blur occurrence area based on the motion blur information, wherein the motion blur information is obtained by:

calculating a first motion blur value based on the motion information, calculating a second motion blur value based on the image characteristic information and calculating a third motion blur value based on the brightness information, applying a first weight to the first motion blur value, a second weight to the second motion blur value and a third weight to the third motion blur value, and multiplying the first motion blur value, the second motion blur value and the third motion blur value with each other after the first weight, the second weight and the third weight are respectively applied to the first motion blur value, the second motion blur value and the third motion blur value.

12. The apparatus as claimed in claim 11, wherein the first voltage level is greater than the second voltage level.

13. The apparatus as claimed in claim 12, wherein the first duty cycle is less than the second duty cycle.

14. The apparatus as claimed in claim 11, wherein the processor is further configured to identify the motion blur occurrence area based on a plurality of frames of the image signal.

* * * * *